US008779932B2

(12) United States Patent
Burzynski

(10) Patent No.: US 8,779,932 B2
(45) Date of Patent: Jul. 15, 2014

(54) POWER SUPPLY AND VOLTAGE MULTIPLICATION FOR SUBMERGED SUBSEA SYSTEMS BASED ON CATHODIC PROTECTION SYSTEM

(75) Inventor: Michal Damian Burzynski, Warsaw (PL)

(73) Assignee: Vetco Gray U.K. Limited, Houston, TX (US)

( * ) Notice: Subject to any disclaimer, the term of this patent is extended or adjusted under 35 U.S.C. 154(b) by 145 days.

(21) Appl. No.: 13/587,674

(22) Filed: Aug. 16, 2012

(65) Prior Publication Data

US 2014/0049399 A1 Feb. 20, 2014

(51) Int. Cl.
*G08B 21/00* (2006.01)
*E21B 33/038* (2006.01)

(52) U.S. Cl.
CPC ..... *E21B 33/0385* (2013.01)
USPC ..... 340/665; 340/686.6; 340/853.2; 340/854.3; 340/10.2; 166/339; 166/349; 439/315; 439/317; 439/337; 439/346

(58) Field of Classification Search
CPC ..... B21B 33/0385
USPC ..... 340/665, 686.6, 853.2, 854.3, 10.2; 166/339, 349; 439/315, 317, 337, 346
See application file for complete search history.

(56) References Cited

U.S. PATENT DOCUMENTS 8,353,350 B2 * 1/2013 Overfield ..... 166/336
8,575,945 B2 * 11/2013 Douglas ..... 324/642

OTHER PUBLICATIONS

Vetco Gray; H-4 Subsea Connectors, brochure, 2008.

* cited by examiner

*Primary Examiner* — Tai T Nguyen
(74) *Attorney, Agent, or Firm* — Bracewell & Giuliani LLP

(57) ABSTRACT

Systems and methods for visually indicating an engagement status of a submerged subsea connector are provided. An example of a system includes a measurement device positioned to provide a signal indicating positive engagement of a locking mechanism for a submerged subsea connector, and a visual engagement status indicator assembly including a visual engagement status indicator positioned on an outside portion of a surrounding frame to provide a visual indication corresponding to an engagement status of the locking mechanism provided by the measurement device. A power supply assembly is configured to interface with portions of an adjacent cathodic protection system to provide supply power or voltage multiplication to the visual engagement status indicator.

20 Claims, 5 Drawing Sheets

POWER SUPPLY AND VOLTAGE MULTIPLICATION FOR SUBMERGED SUBSEA SYSTEMS BASED ON CATHODIC PROTECTION SYSTEM

BACKGROUND OF THE INVENTION

1. Field of the Invention

This invention relates to subsea monitoring systems, in general, and systems and methods of visually indicating an engagement status of a submerged subsea connector which utilize voltage from the cathodic protection system for submerged subsea equipment as a power supply and/or voltage multiplier for a subsea position monitoring system, in particular.

2. Description of the Related Art

Subsea connectors can be utilized to provide upper section emergency disconnect package ("EDP") to lower EDP section connections, blowout preventer ("BOP") stack to wellhead connections, lower marine riser package ("LMRP") to BOP stack connections, completion tree to wellhead connections, TPL/subsea template tiebacks, production riser assembly to subsea manifold connections, single point mooring to anchor base, and caisson completions and artificial island.

Various types of these connectors provide excellent bending in tensile load capabilities, field-proven hydraulically operated engagement, and metal-to-metal sealing. According to an emergency disconnect package implementation, the hydraulic actuators, often referred to as dogs, are typically located well within the frame structure of the emergency disconnect package, making visual verification of complete engagement generally impossible.

A standard technique for reducing corrosion of the metal items and surfaces of the EDP after deployment underwater equipment, which are prone to corrosion due to the electrolytic nature of the surrounding seawater, is to use cathodic protection ("CP"). A widely-used form of CP is the galvanic anode-type cathodic protection, in which a sacrificial metal surface is positioned proximate to the metal items to be protected. The sacrificial metal material is chosen which has a greater magnitude electrochemical potential than the item to be protected. Commonly used sacrificial metal materials include, for example, alloys of zinc, magnesium, and aluminum. When located subsea adjacent the metal components and surfaces to be protected, for example, the sacrificial metal material will be corroded instead of to the item being protected. Eventually, the sacrificial material will be corroded to such an extent that replacement of the sacrificial material is necessary.

SUMMARY OF THE INVENTION

Recognized by the inventor is that it would be desirable to provide a visual indication of positive engagement of them at a location outside the frame structure, sufficient to be perceived by a remote operated vehicle ("ROV"). Recognized by the inventor is the need for a system which provides electrical current to power small voltage devices such as, for example, solid-state signal lamps connected to the lower portion of a subsea emergency disconnect package, a subsea Christmas tree, or other similarly located subsea equipment, which provide measurements and/or visual position indications of dog engagement. Still further recognized by the inventor is that a tap into the main power system or an additional umbilical line to power search system would excessively complicate the emergency disconnect package and/or degrade its capabilities.

Also recognized by the inventor is that the cathodic protection system of the subsea emergency disconnect package equipment could be used as a galvanic cell to generate supply voltage or voltage multiplication for a small voltage/low-power minor device. Stated in an alternative manner, recognized by the inventor is that the protective potential or closed-circuit anode potential is used as a power supply for the small voltage/low-power devices including visual engagement status indicators.

In view of the foregoing, various embodiments of the present invention advantageously feature systems and methods that provide electrical current to power small voltage devices connected to the lower portion of a subsea system such as, for example, an emergency disconnect package, a lower marine riser package, a subsea Christmas tree or other similarly located subsea equipment, which provide measurements and/or visual position indications of one or more associated subsea components of the subsea equipment. Various embodiments are configured to use the cathodic protection system of the subsea equipment as a galvanic cell to generate supply voltage or voltage multiplication for a small voltage/low-power minor device. According to various embodiments, the protective potential or closed-circuit anode potential is used as a power supply for the small voltage/low-power devices.

Various embodiments of the present invention provide a power supply and/or voltage or current multiplication system which utilizes the voltage from the cathodic protection system for a submerged subsea system as a power supply and/or voltage multiplier source for a subsea monitoring system. Various embodiments of the power supply and voltage multiplication system negates a need to provide long and expensive electrical lines to supply small voltage minor devices. Various embodiments also negate the need to tap into a main subsea system electrical supply or that of an ROV, or the need to provide a mechanical system solution capable of providing such measurements or visual indication.

According to various embodiments, a subsea monitoring system can include a system for visually indicating an engagement status of a submerged subsea connector. More specifically, an example of an embodiment of a system for providing a visual indication of subsea connector engagement can include a measurement device or devices (e.g., piezoelectric device) positioned to provide at least a threshold level of voltage indicative of engagement of a locking or other connection mechanism (e.g., strain or position) for a submerged subsea connector, and a visual engagement status indicator assembly. The assembly can include a light emitting visual engagement status indicator positioned, for example, on an outside portion of a surrounding frame member to provide a visual indication corresponding to an engagement status of the connection mechanism provided by the piezoelectric device, and a power supply assembly configured to interface with portions of an adjacent cathodic protection system to provide supply power or voltage multiplication to the visual engagement status indicator. In an exemplary embodiment, a measurement device in the form of a piezoelectric device measures strain resulting from engagement of a connecting ring operably coupled to one or more hydraulic cylinders connected to an upper connector body assembly of an emergency disconnect package with one or more locking members (e.g., dogs) configured to engage one or more engagement recesses extending into an outer surface of a subsea connector for a lower portion of the emergency disconnect package. A threshold level of the strain can be used as a reference to indicate engagement of the one or more locking members with the one or more engagement recesses of the subsea connector.

According to an embodiment, the power supply assembly includes a switching circuit (e.g., incorporating a logical "AND") configured to complete a circuit between a first element of the cathodic protection system defining an anode, and the visual engagement status indicator when the piezoelectric device provides a signal voltage having an amplitude exceeding a threshold voltage level. A first conductor extends from the piezoelectric device and is connected to a first terminal of the switching circuit, and a second conductor extends from the first element (anode) of the cathodic protection system. A visual engagement status indicator is electrically coupled to a second element of the cathodic protection system defining a cathode to emit a sufficient light level to be visually detected via a remotely operated vehicle when the piezoelectric device encounters a threshold level of strain or other movement, depending upon the type of visit electric device utilized and its positioning.

Embodiments of the present invention also include methods of visually indicating an engagement status of a submerged subsea connector or other component. An example of the method can include the steps of positioning a measurement device to provide a signal indicating positive engagement of a locking mechanism for a submerged subsea connector, positioning a visual engagement status indicator to provide a visual indication corresponding to an engagement status of the locking mechanism provided by the measurement device, and interfacing components of a power supply assembly with portions of a cathodic protection system adjacent the visual engagement status indicator to provide supply power or voltage multiplication to the visual engagement status indicator. The step of positioning a visual engagement status indicator can include electrically coupling the visual engagement status indicator to an element of the cathodic protection system defining a cathode to emit a sufficient light level to be visually detected via a remotely operated vehicle ("ROV") when the measurement device encounters a threshold level of strain or other movement. The steps can also include measuring strain resulting from engagement an engagement surface of a locking member with a corresponding locking recess extending into an outer surface of a subsea connector for a lower portion of the emergency disconnect package. A threshold level of the strain indicates engagement of the engagement surface of the locking member with the locking recess portion of the subsea connector as a result of engagement of the locking member by a connecting ring operably coupled to one or more hydraulic cylinders connected to an upper connector body assembly of the emergency disconnect package. When the threshold level of strain it is met, the visual engagement status indicator can be "lit" to provide a visual indication visible to an ROV that the component is engaged.

BRIEF DESCRIPTION OF THE DRAWINGS

So that the manner in which the features and advantages of the invention, as well as others which will become apparent, may be understood in more detail, a more particular description of the invention briefly summarized above may be had by reference to the embodiments thereof which are illustrated in the appended drawings, which form a part of this specification. It is to be noted, however, that the drawings illustrate only various embodiments of the invention and are therefore not to be considered limiting of the invention's scope as it may include other effective embodiments as well.

DETAILED DESCRIPTION

The present invention will now be described more fully hereinafter with reference to the accompanying drawings, which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout. Prime notation, if used, indicates similar elements in alternative embodiments.

In view of the foregoing, various embodiments of the present invention advantageously feature systems and methods that provide electrical current to power small voltage devices connected to the lower portion of a subsea system such as, for example, an emergency disconnect package, a lower marine riser package, a subsea Christmas tree or other similarly located subsea equipment, which provide measurements and/or visual position indications of one or more associated subsea components of the subsea equipment. Various embodiments of the present invention provide a power supply and/or voltage or current multiplication system which utilizes voltage from the cathodic protection system for a submerged subsea system as a power supply and/or voltage multiplier source for a subsea monitoring system. According to various embodiments, the subsea monitoring system can include a system for visually indicating an engagement status of a submerged subsea connector.

Figure 1:
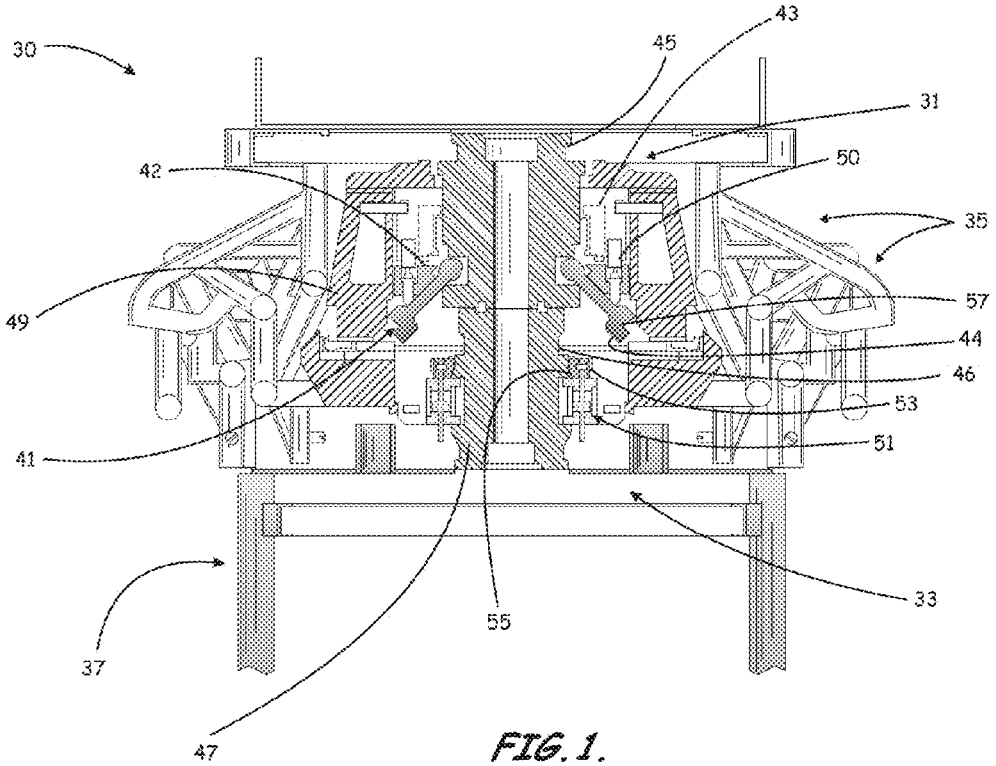
FIG. 1 is a perspective view of an emergency disconnect package protected by a cathodic protection system.

FIG. 1 illustrates an emergency disconnect package (EDP) 30 including an upper section 31, the lower section 33, a multi-part frame 35, positioned atop a subsea Christmas tree (not shown) via a lower marine riser package (LMRP) 37. The EDP 30 is connected to a lower end of a riser string (not shown) to allow a surface vessel to separate the riser string from the subsea tree typically during times of emergency or bad weather.

The upper section 31 of the EDP is held in place by a set of hydraulic (hydraulically actuated) cylinders and/or upper connector dogs 41 slidably connected to an upper connector cam ring 42, which are engaged through actuation of a hydraulic piston 43, to cause an engagement surface 44 of the dogs 41, themselves typically pivotally connected to or interfaced with an upper subsea connector 45, to extend into and engage a recess 46 in the lower subsea connector 47 in the lower section 33 of the EDP 30. The dogs 41 function to connect the upper section 31 of the EDP 30 to the lower section 33 of the EDP 30. In the illustrated embodiment, the hydraulic piston 43 is connected to an upper connector body assembly 49 to provide such engagement mechanism. One or more upper connector stops 50 limit movement of the cam ring 42 and/or movement of dogs 41. The lower section 33 of the EDP 30 includes one or more lower connector pistons 51 connected to a lower connector lock ring 53 which includes an engagement surface 55, which engages surface 57 located on lower portion of dogs 41, which functions to lock dogs 41 in the engagement position with recess 46. According to an exemplary embodiment, subsea connector 45 is a sixteen inch HAR subsea connector.

Figure 2:
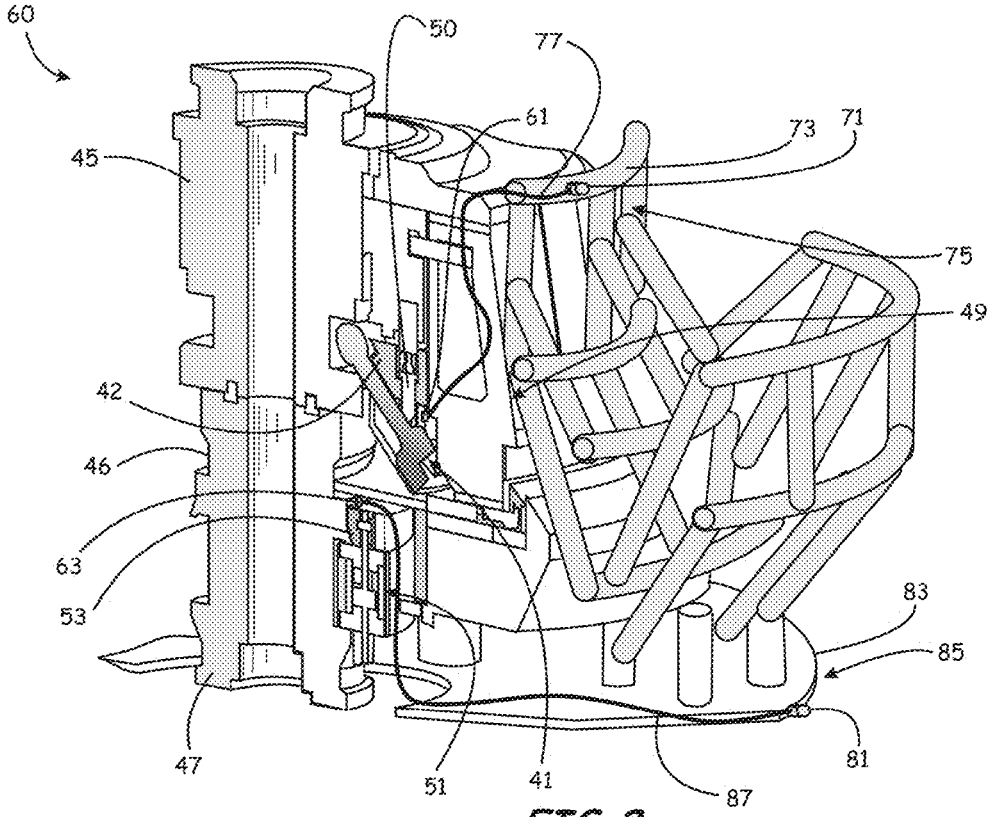
FIG. 2 is a perspective view of a general system architecture of a system for visually indicating an engagement status of a submerged subsea connector applied to the emergency disconnect package of FIG. 1 according to an embodiment of the present invention.

FIG. 2 illustrates a general system architecture of a system 60 for visually indicating an engagement status of a submerged subsea connector 45, 47, applied to the EDP 30. At least one but more typically a plurality of, e.g., piezoelectric measurement devices 61 (only one shown) are connected to a portion of the upper body assembly 49 or upper connector cam ring 42 to sense the position of or measure stresses on the upper connector cam ring 42. Also or alternatively, a measurement device 61 can be positioned on the cam ring 42 to sense the position of or measure stresses on one or more of the hydraulic cylinders/upper connector dogs 41 or the position of or stresses on the upper connector stops 50. Additional or alternative measurement devices 61 can be connected to provide direct redundancy and/or can be connected to other components to provide indirect redundancy. Note, the measurement devices 61 can include strain gauges, position sensors, and/or others as understood by those of ordinary skill in the art and can be connected to various other components of the EDP 30 as also understood by those of ordinary skill in the art.

At least one or more but typically a plurality of measurement devices 63 (only one shown) are positioned on a main structural element of or adjacent to the lower section connector 47 to provide position measurements based on the position or applied strain/stresses on the lower connector locking ring 53 resulting from engagement of engagement surface 55 of the locking ring 53 with the engagement surface 57 of the dogs 41. The measurement device or devices 63 are, however, typically positioned upon one of the lower connector pistons 51 or on a component positioned between the lower connector lock ring 53 and one or more of the lower connector pistons 51. The amount of strain or movement can provide an indication that the subsea connector 47 is properly positioned.

A corresponding plurality of visual engagement status indicators 71 (only one shown) are connected to an outer surface 73 of a medial or upper beam 75 of the multi-part frame 35. A conductor 77 connects between a corresponding one of the measurement devices 61 and the respective visual engagement status indicators 71. Also or alternatively, a second plurality of visual engagement status indicators 81 are connected to an outward facing surface 83 of a base portion 85 of the multi-part frame 35. A conductor 87 connects between a corresponding one of the measurement devices 63 and the respective visual engagement status indicator 81. Additional or alternative visual engagement status indicators 71, 81, can be connected around the multi-part frame to provide redundancy and/or assist a remote operating vehicle ("ROV") in visually detecting its status.

According to an exemplary embodiment, the visual engagement status indicator or indicators 71 each include one or more light emitting diodes positioned to provide a visual signal indicating that the upper section subsea connector 45 is properly engaged atop the lower section connector 47. Similarly, the visual engagement status indicator or indicators 81 provide a visual signal indicating that the lower section connector 47 is properly engaged. Each visual engagement status indicator 71, 81, can be implemented as a basic cluster of one or more light emitting diodes positioned to provide a visual indication corresponding to the measurements provided by the measurement devices 61, 63. For example, with respect to the measurement devices 61, a threshold level of strain or position change provides a threshold level of voltage indicating engagement of the engagement surface 44 of dogs 41 in the corresponding locking recess or recesses 46. With respect to the measurement devices 63, a threshold level of strain or position change similarly provides the requisite threshold level of voltage. Note, other forms of light emitting devices as known to those of ordinary skill in the can be utilized.

Figure 3:
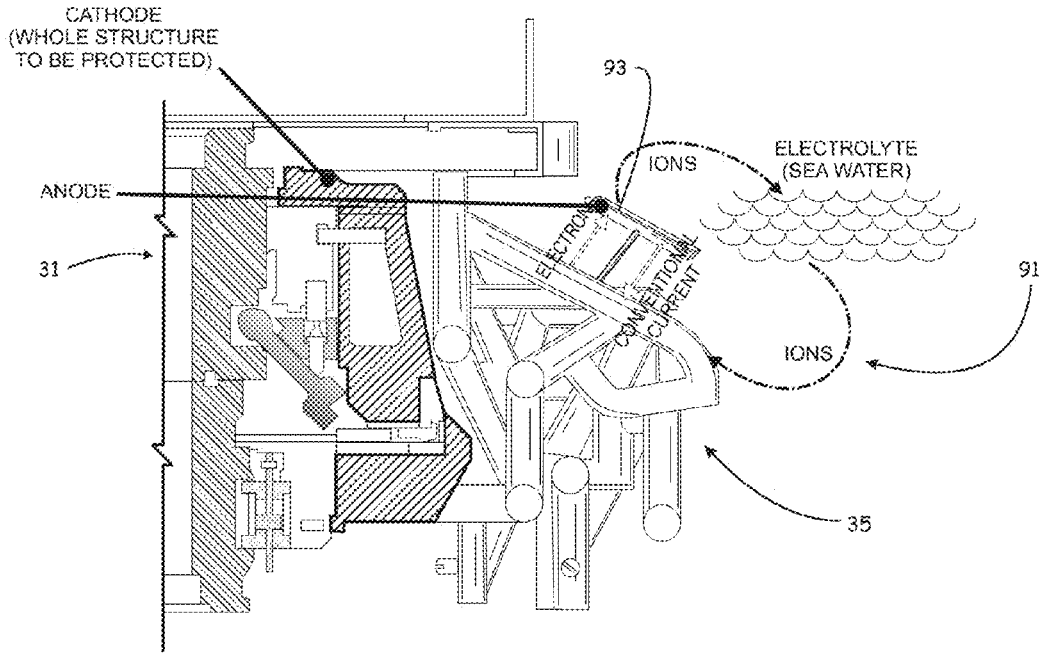
FIG. 3 is a perspective view of a portion of a frame of the emergency disconnect package protected by a cathodic protection system, illustrating operation of the cathodic protection system.

Referring to FIG. 3, almost the entire structure of the emergency disconnect package (EDP) 30 is protected from corrosion by a cathodic protection system 91. The cathodic protection system 91 includes multiple sets of sacrificial metal panels or bars 93 (only one shown in exploded view) positioned proximate to the metal items of the upper section 31, the lower section 33, and the multi-part frame 35 to be protected. The sacrificial metal material is chosen which has a greater magnitude electrochemical potential than the item to be protected. Commonly used sacrificial metal materials include, for example, alloys of zinc, magnesium, and aluminum, along with others as known and understood by those of ordinary skill in the art.

Figure 4:
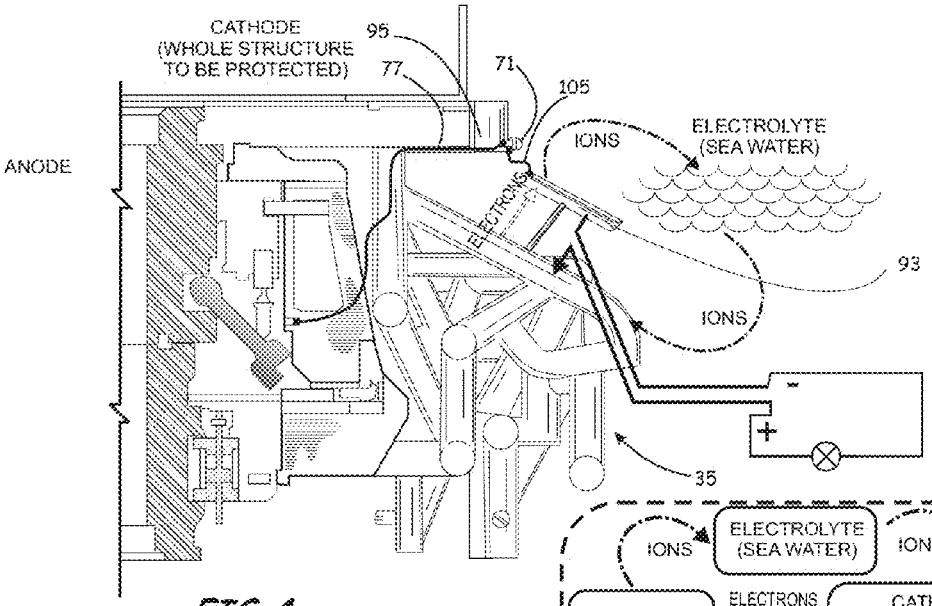
FIG. 4 is a perspective view of a portion of the frame of the emergency disconnect package protected by the cathodic protection system of FIG. 3, illustrating powering of minor electronic devices for utilization of the cathodic protection system according to an embodiment of the present invention.
Figure 5:
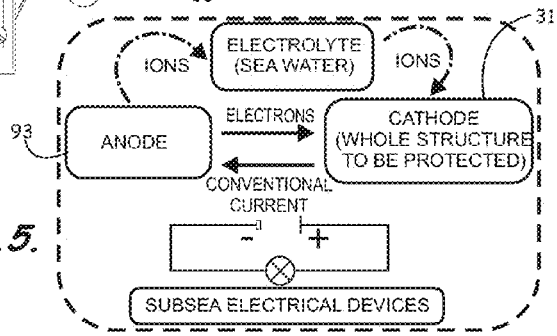
FIG. 5 is a schematic diagram illustrating the functional operation of the cathodic protection system.

Referring to FIGS. 4 and 5, the seawater functions as an electrolyte between the sacrificial metal panels or bars 93 and the surfaces 95 (e.g., surface 73 or 83 of FIG. 2 and others) of the upper section 31, lower section 33, and/or frame 35 to be protected. These surfaces 95 serve as a positive electrode or cathode and each sacrificial metal panel or bar functions as an electron-producing negative electrode or anode. The two metal components function as electrodes, causing an electrochemical reaction each generates a small electrical potential (i.e., forming a galvanic cell). As illustrated in the figure, electrons and ions flow between the sacrificial metal panels or bars 93 and the respective surface 95.

Rather than suffer the complication of tapping into the main supply power or running a separate conductor to power each visual engagement status indicator 71, 81, according to one or more embodiments, the visual engagement status indicators 71, 81, can be electrically interfaced with the frame surface 95 and with the sacrificial metal panel or bars 91. In an exemplary embodiment, multiple low voltage, low amperage visual engagement status indicator "assemblies" 71, 81, are connected directly to an exposed outward facing surface 95 of the frame 35 to interface with the "cathode" and a small conductor extends to the nearest sacrificial metal panel or bar 93 to interface with the "anode" to leech power produced by the cathodic protection system.

FIGS. 6-9 illustrate various circuits having different power supply assembly arrangements for the visual engagement status indicator assemblies 71, 81, configured to interface with the cathodic protection system 91 to provide supply power or voltage multiplication to the visual engagement status indicator 97, and to selectively pass a signal from the, e.g., piezoelectric measurement devices 61, 63, to provide a visual indication of the engagement status of the respective engagement components being monitored.

Figure 6:
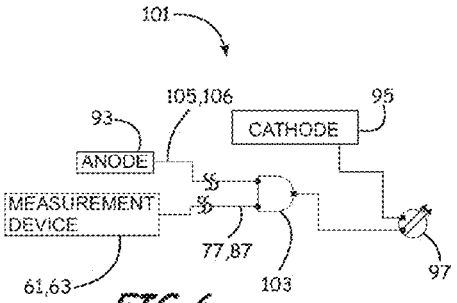
FIGS. 6-9 are schematic diagrams of various circuits having different power supply assembly arrangements configured to interface with the cathodic protection system of FIG. 3 according to an embodiment of the present invention.

FIG. 6 illustrates a circuit design 101 which employs a logical "AND" circuit 103 so that when the respective piezoelectric device 61, 63, encounters a threshold level of strain or other movement, the visual engagement status indicator 97 will be provided sufficient voltage (voltage exceeding the threshold voltage) and electrical current to emit a sufficient light level to be detected by an ROV. In the illustration, the logical "AND" circuit 103 completes a circuit between cathode 95 and anode 93 (connected via conductors 105, 106) when measurement device 61, 63, provides at least the minimum threshold voltage. The logical "AND" circuit 103 can be in the form of a switching circuit which incorporates either solid-state or mechanical technology such as, for example, a mechanical relay as will be understood by those of ordinary skill in the art, between at least one leg of the circuit.

Figure 7:
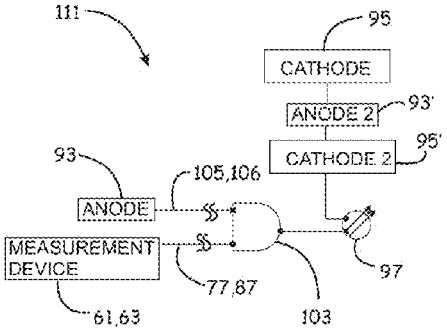

FIG. 7 illustrates circuit 111 which is, in essence, the circuit 101 connected in series with a second cathode-anode pair. In this configuration, the second cathode-anode pair is functionally insulated from the pair shown in FIG. 5. As in circuit 101, the anode 93 and the output measurement device 61, 63, are functionally connected to a logical "AND" 103 to power the visual engagement status indicator 97. In this configuration, however, the visual engagement status indicator 97 is connected to a second protected structure forming a second cathode 95', and the first cathode 95 is electrically connected to a second sacrificial structure forming a second anode 93'.

Figure 8:
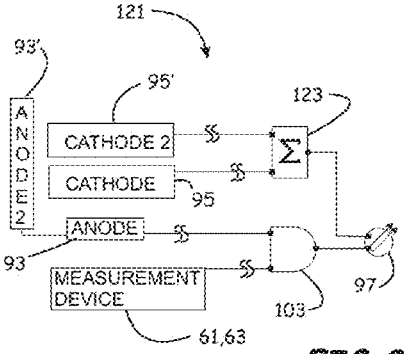

FIG. 8 illustrates circuit 121 which is, in essence, the circuit 101 connected in parallel with the second cathode-anode pair. As in circuit 101, the anode 93 and the output measurement device 61, 63, are functionally connected to a logical "AND" 103 to power the visual engagement status indicator 97. In this configuration, however, the visual engagement status indicator 97 is functionally connected to both the first and the second protected structures forming the first and the second cathodes 95, 95', for example, via a summing circuit 123, and the first sacrificial structure forming the first anode 93 is electrically connected to the second sacrificial structure forming the second anode 93'.

Figure 9:
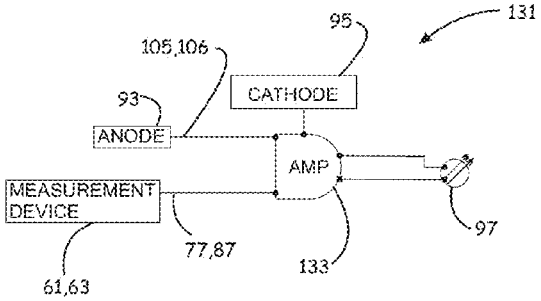

FIG. 9 illustrates circuit 131, which is, in essence, the circuit 101 having an amplifier 133 positioned between cathode 95 and anode 93 and the visual engagement status indicator 97. One of ordinary skill in the art will recognize that various parallel and series combinations of additional cathode-anode pairs can be employed to provide voltage and/or current multiplication as needed to power the visual engagement status indicator assemblies 71, 81.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification. For example, although described as providing power to visual engagement status indicators 97, one of ordinary skill in the art would understand that the scope of the invention extends to utilization of the potential between anode and cathode of a cathodic protection system (working as a galvanic cell) to supply power to other small voltage devices.

The invention claimed is:

1. A system for visually indicating an engagement status of a submerged subsea connector of a subsea apparatus including one or more components prone to corrosion, the system comprising:

a measurement device positioned to provide a signal indicating positive engagement of a locking mechanism for the submerged subsea connector; and a visual engagement status indicator assembly including a visual engagement status indicator positioned to provide a visual indication corresponding to an engagement status of the locking mechanism provided by the measurement device, and a power supply assembly configured to interface with portions of an adjacent cathodic protection system providing cathodic protection to the subsea apparatus to provide supply power or voltage multiplication to the visual engagement status indicator, the cathodic protection system including a first element comprising a sacrificial material functioning as an anode and a second element comprising at least a portion of one or more components prone to corrosion functioning as a cathode, whereby the first and second elements generate an electrical potential when submerged in seawater.

2. A system as defined in claim 1, wherein the measurement device is a first measurement device comprising a first piezoelectric strain gauge or position sensor connected to one or more of the following: an outer surface of a cam ring for engaging one or more connector dogs each positioned to engage a recess in a lower subsea connector, the one or more connector dogs operably coupled with the cam ring, and portions of an upper connector body assembly operably coupled with the cam ring to measure position of or stress on the cam ring, the system further comprising a second measurement device comprising a second piezoelectric strain gauge or position sensor located on one of the following: an outer surface of a lock ring for engaging an engagement surface of each of the one or more connector dogs, a piston operably coupled with the lock ring, and a component located between the lock ring and the piston to measure position of or stress on the lock ring.

3. A system as defined in claim 1, wherein the measurement device comprises a piezoelectric device, and wherein the piezoelectric device is positioned to measure strain resulting from engagement of an engagement surface of a locking member with a corresponding locking recess extending into an outer surface of a subsea connector for a lower portion of an emergency disconnect package, a threshold level of the strain indicating engagement of the engagement surface of the locking member with the locking recess portion of the subsea connector as a result of engagement of the locking member by a connecting ring operably coupled to one or more hydraulic cylinders connected to an upper connector body assembly of the emergency disconnect package.

4. A system as defined in claim 1, wherein the measurement device comprises a piezoelectric strain gauge or position sensor device positioned on an outer surface of one or more of the following: a cam ring for engaging one or more connector dogs positioned to engage a recess in a lower subsea connector, the one or more connector dogs operably coupled with the cam ring, and a portion of an upper connector body assembly operably coupled with the cam ring to measure position of or stress on the cam ring, and a lock ring for engaging an engagement surface of the one or more connector dogs, a piston operably coupled with the lock ring, and a component between the lock ring and the piston to measure position of or stress on the lock ring.

5. A system as defined in claim 1, wherein the power supply assembly comprises: a switching circuit configured to complete a circuit between the first element of the cathodic protection system and the visual engagement status indicator when the measurement device provides a signal voltage having an amplitude exceeding a threshold voltage level; a first conductor extending between the measurement device and a first terminal of the switching circuit; and a second conductor extending between the first element of the cathodic protection system and a second terminal of the switching circuit; and wherein the visual engagement status indicator is electrically coupled to the second element of the cathodic protection system defining the cathode to emit a sufficient light level to be visually detected via a remotely operated vehicle ("ROV") when the measurement device encounters a threshold level of strain or other movement.

6. A system as defined in claim 1, wherein the visual engagement status indicator comprises one or more light emitting diodes.

7. A system as defined in claim 1, wherein the visual engagement status indicator comprises one or more light emitting diodes positioned on an outward facing outer surface of an upper frame element of an upper portion of an emergency disconnect package or an outward facing outer surface of the lower frame element of a lower portion of the emergency disconnect package.

8. A system as defined in claim 1, wherein the visual engagement status indicator is a first visual engagement status indicator including one or more light emitting diodes located on an outward facing outer surface of a first frame element of an emergency disconnect package, the system further comprising a second visual engagement status indicator including one or more light emitting diodes located on an outward facing outer surface of a second frame element of the emergency disconnect package.

9. A system as defined in claim 1, wherein the visual engagement status indicator is electrically connected in series with a plurality of separate segments of the cathodic protection system.

10. A system as defined in claim 1, wherein the visual engagement status indicator is electrically connected in parallel with a plurality of separate segments of the cathodic protection system.

11. A system for visually indicating an engagement status of a submerged subsea connector of a subsea apparatus including one or more components prone to corrosion, the system comprising:

a piezoelectric device positioned to provide at least a threshold level of voltage indicative of engagement of a connection mechanism for the submerged subsea connector; and a visual engagement status indicator assembly including a light emitting visual engagement status indicator positioned to provide a visual indication corresponding to an engagement status of the connection mechanism provided by the piezoelectric device, and a power supply assembly configured to interface with portions of an adjacent cathodic protection system providing cathodic protection to the subsea apparatus to provide supply power or voltage multiplication to the visual engagement status indicator, the cathodic protection system including a first element comprising a sacrificial material functioning as an anode and a second element comprising at least a portion of one or more components prone to corrosion functioning as a cathode, whereby the first and second elements generate an electrical potential when submerged in seawater.

12. A system as defined in claim 11, wherein the piezoelectric device measures strain resulting from engagement of a connecting ring operably coupled to one or more hydraulic cylinders connected to an upper connector body assembly of an emergency disconnect package with one or more engagement surfaces of one or more actuators configured to engage one or more recesses extending into an outer surface of a subsea connector for lower portion of the emergency disconnect package, a threshold level of the strain indicating engagement of the one or more engagement surfaces of the one or more actuators with the one or more recesses of the subsea connector.

13. A system as defined in claim 11, wherein the piezoelectric device measures strain resulting from engagement of a lock ring with an engagement surface of each of one or more connector actuators, operably coupled to a piston to measure strain on the locking ring, a threshold level of the strain indicating locking engagement of the lock ring with the one or more connector actuators.

14. A system as defined in claim 11, wherein the visual engagement status indicator comprises one or more light emitting diodes;

wherein the power supply assembly comprises: a switching circuit configured to complete a circuit between the first element of the cathodic protection system and the visual engagement status indicator when the piezoelectric device provides a signal voltage having an amplitude exceeding a threshold voltage level; a first conductor extending from the piezoelectric device and connected to a first terminal of the switching circuit; and a second conductor extending from the first element of the cathodic protection system; and wherein the visual engagement status indicator is electrically coupled to a second element of the cathodic protection system to emit a sufficient light level to be visually detected via a remotely operated vehicle when the piezoelectric device encounters a threshold level of strain or other movement.

15. A method of visually indicating an engagement status of a submerged subsea connector of a subsea apparatus including one or more components prone to corrosion, the method comprising steps of:

positioning a measurement device to provide a signal indicating positive engagement of a locking mechanism for a submerged subsea connector;

positioning a visual engagement status indicator to provide a visual indication corresponding to an engagement status of the locking mechanism provided by the measurement device; and interfacing components of a power supply assembly with portions of a cathodic protection system adjacent the visual engagement status indicator to provide supply power or voltage multiplication to the visual engagement status indicator, the cathodic protection system functioning to provide cathodic protection to the one or more components of the subsea apparatus and including a first element comprising a sacrificial material functioning as an anode and a second element comprising at least a portion of one or more components prone to corrosion functioning as a cathode, whereby the first and second elements generate an electrical potential when submerged in seawater.

16. A method as defined in claim 15, wherein the measurement device comprises a piezoelectric strain gauge or position sensor device, and wherein the step of positioning the measurement device comprises positioning the piezoelectric strain gauge or position sensor device on an outer surface of one or more of the following: a cam ring for engaging one or more connector actuators positioned to engage a recess in a lower subsea connector, one or more connector dogs operably coupled with the cam ring, and an upper connector body assembly operably coupled with the cam ring, to measure position of or stress on the cam ring, and on a lock ring for engaging an interface in a lower subsea connector, a piston operably coupled with the lock ring, and a component between the lock ring and the piston to measure position of or stress on the lock ring.

17. A method as defined in claim 15, wherein the measurement device is a first measurement device comprising a first piezoelectric strain gauge or position sensor;

wherein the step of positioning the first measurement device comprises connecting the first measurement device to an outer surface of one or more of the following: a cam ring for engaging one or more connector dogs each positioned to engage a recess in a lower subsea connector, the one or more connector dogs of a set of connector dogs operably coupled with the cam ring, and a portion of an upper connector body assembly operably coupled with the cam ring to measure position of or stress on the cam ring; and wherein the method further comprises the step of connecting a second measurement device comprising a second piezoelectric strain gauge or position sensor to an outer surface of one or more of the following: a lock ring for engaging an engagement surface of the one or more connector dogs, a piston operably coupled with the lock ring, and a component between the lock ring and the piston to measure position of or stress on the lock ring.

18. A method as defined in claim 15, wherein the measurement device comprises a piezoelectric strain gauge device, and wherein the method further comprises the step of:

measuring strain resulting from engagement of an engagement surface of a locking member with a corresponding locking recess extending into an outer surface of a subsea connector for a lower portion of an emergency disconnect package, a threshold level of the strain indicating engagement of the engagement surface of the locking member with the locking recess portion of the subsea connector as a result of engagement of the locking member by a connecting ring operably coupled to one or more hydraulic cylinders connected to an upper connector body assembly of the emergency disconnect package.

19. A method as defined in claim 15, wherein the measurement device comprises a piezoelectric strain gauge or position sensor device;

wherein the step of interfacing components of a power supply assembly with portions of a cathodic protection system includes:

configuring a switching circuit to complete a circuit between the first element of the cathodic protection system and the visual engagement status indicator when the measurement device provides a signal voltage having an amplitude exceeding a threshold voltage level, connecting a first conductor between the piezoelectric device and a first terminal of the switching circuit, and connecting a second conductor between the first element of the cathodic protection system and a second terminal of the switching circuit; and wherein the step of positioning a visual engagement status indicator includes electrically coupling the visual engagement status indicator to the second element of the cathodic protection system to emit a sufficient light level to be visually detected via a remotely operated vehicle ("ROV") when the measurement device encounters a threshold level of strain or other movement.

20. A method as defined in claim 15, wherein the visual engagement status indicator comprises one or more light emitting diodes, and wherein the step of positioning the visual engagement status indicator includes:

positioning the visual engagement status indicator on one or more of the following surfaces: an outward facing outer surface of an upper frame element of an upper portion of an emergency disconnect package, and an outward facing outer surface of the lower frame element of a lower portion of the emergency disconnect package.

* * * * *